US006768471B2

(12) United States Patent
Bostwick et al.

(10) Patent No.: US 6,768,471 B2
(45) Date of Patent: Jul. 27, 2004

(54) COMFORMAL PHASED ARRAY ANTENNA AND METHOD FOR REPAIR

(75) Inventors: Richard N. Bostwick, Snoqualmie, WA (US); Gary E. Miller, Auburn, WA (US); David N. Rasmussen, Edmonds, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 10/205,411

(22) Filed: Jul. 25, 2002

(65) Prior Publication Data

US 2004/0017322 A1 Jan. 29, 2004

(51) Int. Cl.[7] ..... H01Q 13/00
(52) U.S. Cl. ..... 343/853; 343/776; 343/778
(58) Field of Search ..... 343/776, 778, 343/853, 700 MS, 725, 777; 342/368, 25, 179, 175, 373, 371, 375

(56) References Cited

U.S. PATENT DOCUMENTS 4,616,230 A 10/1986 Antonucci et al. ..... 342/373
5,160,936 A 11/1992 Braun et al. ..... 343/725
5,248,977 A * 9/1993 Lee et al. ..... 342/25
5,276,452 A 1/1994 Schuss et al. ..... 342/371
5,276,455 A 1/1994 Fitzsimmons et al. ..... 343/777
5,347,287 A 9/1994 Speciale ..... 342/375
5,463,656 A 10/1995 Polivka et al. ..... 375/200
5,512,906 A 4/1996 Speciale ..... 342/375
5,886,671 A * 3/1999 Riemer et al. ..... 343/776

* cited by examiner

*Primary Examiner*—James Clinger
(74) *Attorney, Agent, or Firm*—Alston & Bird LLP

(57) ABSTRACT

A conformal phased array antenna and associated method of repairing the antenna are provided. The antenna has individual subassemblies or line replaceable units such that the antenna can be repaired without completely removing the entire antenna. The antenna generally includes a planar antenna subassembly including an array of RF modules disposed in a reference plane. The antenna also typically has a contoured waveguide subassembly including a contoured aperture honeycomb structure. The contoured aperture honeycomb structure defines a number of passages that are in communication with respective RF modules. The exterior surface of the contoured aperture honeycomb structure that faces away from the planar antenna subassembly is contoured such that at least portions of this surface are at an oblique angle with respect to the reference plane. This contoured surface may advantageously be shaped to match the contour of the surface of the structure to which the antenna is mounted.

24 Claims, 4 Drawing Sheets

COMFORMAL PHASED ARRAY ANTENNA AND METHOD FOR REPAIR

FIELD OF THE INVENTION

The present invention relates generally to phased array antennas and, more particularly, to conformal phased array antennas and associated methods of repair.

BACKGROUND OF THE INVENTION

Antennas are widely utilized in order to transmit and receive a variety of signals. For example, antennas are prevalent in radio frequency (RF) communication systems. One common type of antenna utilized for high data rate communications with moving platforms, such as aircraft or the like, is a phased array antenna. Phased array antennas generally include a number of identical radiating elements. Each element may include a phase shifter and/or a time delay circuit. In addition, each element may include an amplifier. By adjusting the phase shift of each element, the beam transmitted and/or received by the phased array antenna may be formed electronically and steered without physical movement of the antenna aperture.

One conventional phased array antenna is depicted in FIG. 1. As shown, the phased array antenna 100 includes a number of RF modules 102. Each RF module generally includes a phase shifter and an amplifier. This conventional phased array antenna also includes a shim element 104 defining a number of openings 106 arranged in the predefined pattern or an array. The RF modules are therefore mounted within respective openings defined by the shim element such that the RF modules are also disposed in the predefined pattern. The phased array antenna also includes a multilayer wiring board 108 having a number of wires, conductive traces or the like. The shim element is disposed upon the multilayer wiring board such that the RF modules make contact with the multilayer wiring board and, in particular, with respective wires or conductive traces carried by the multilayer wiring board. Although not illustrated, the multilayer wiring board is also generally connected to a power supply, ground and a clock, as well as various address and data lines. The multilayer wiring board therefore supplies power, ground and clock signals to the RF modules, while permitting data to be transmitted to and from the RF modules.

The phased array antenna 100 of FIG. 1 also includes an aperture honeycomb structure 110 having a pair of opposed planar surfaces and defining a plurality of passages 112 extending between the opposed planar surfaces. The aperture honeycomb structure defines the passages in the same configuration as the openings defined by the shim element 104. As such, the RF modules 102 mounted within the openings 106 defined by the shim element are aligned with respective passages defined by the aperture honeycomb structure. The aperture honeycomb structure may be formed of various materials, but is typically formed of a metal, such as aluminum, a conductively coated or conductively plated plastic, a metal matrix composite or a conductively coated composite material. Dielectric inserts 114 are disposed within the passages defined by the aperture honeycomb structure. These dielectric inserts facilitate the propagation of signals through the passages such that the respective RF module may transmit and/or receive signals via the dielectric loaded passages defined by the aperture honeycomb structure. The phased array antenna also includes the wide angle impedance match (WAIM) layer 116 that overlies the outer surface of the aperture honeycomb structure. The WAIM layer is constructed from a number of dielectric layers that mitigate the impact of mutual coupling effects on aperture performance at relatively high scan angles. The phased array antenna further includes an enclosure 118 within which the other components of the phased array antenna are disposed. The enclosure protects and maintains the alignment of these other components and facilitates the mounting of the phased array antenna to a structure, such as to an airframe or the skin of an aircraft, by permitting the enclosure to be mechanically connected to the structure. While one conventional phased array antenna is depicted in FIG. 1 and described above, another phased array antenna is described by U.S. Pat. No. 5,276,455 to George W. Fitzsimmons, et al., the contents of which are incorporated herein in their entirety.

Phased array antennas are generally mounted proximate the exterior surface or skin of a structure. In order to protect the phased array antenna and to facilitate the relatively smooth flow of air thereabout, conventional phased array antennas are typically housed within an aerodynamic fairing, a radome or the like. Various types of aerodynamic fairings and radomes, such as blister or bubble radomes, can be utilized to protect the phased array antenna and to permit the relatively free flow of air therearound. Housing the phased array antenna within an aerodynamic fairing, a radome or the like is particularly advantageous in those instances in which the phased array antenna does not conformally blend into the surrounding structure.

As illustrated in FIG. 1 and as described above, the outer surface of a conventional phased array antenna is planar. In many applications, however, the phased array antenna is mounted to a structure that is not planar, but is curved or has some other contour. In these instances, a conventional phased array antenna cannot generally be mounted conformal to or flush with the surrounding surface of the structure. By housing the phased array antenna within an aerodynamic fairing, a radome or the like, however, the phased array antenna is protected.

While aerodynamic fairings, radomes and the like provide a number of advantages, these structures also create several disadvantages. In particular, aerodynamic fairings, radomes or the like increase the costs of the resulting antenna assembly. In addition, aerodynamic fairings, radomes or the like may adversely affect the RF performance of the phased array antenna. In conjunction with those phased array antennas mounted upon moving structures, such as aircraft, an aerodynamic fairing, radome or the like adds weight and imposes an aerodynamic drag penalty which, in turn, will increase fuel consumption among other things. Further, an aerodynamic fairing, a radome or the like will also disadvantageously increase the radar cross section of the structure, such as the aircraft, upon which the phased array antenna is mounted.

SUMMARY OF THE INVENTION

A phased array antenna and associated method of repairing a phased array antenna are provided to address the aforementioned and other disadvantages associated with conventional phased array antennas. In this regard, a phased array antenna of the present invention may be designed to conform with the surface or skin of the structure to which the phased array antenna is mounted. As such, the phased array antenna of the present invention need not be housed within an aerodynamic fairing, a radome or the like. Moreover, by designing the phased array antenna to have individual subassemblies or line replaceable units, the phased array antenna can be readily repaired without completely removing or deconstructing the phased array antenna.

According to one aspect of the present invention, the phased array antenna includes a planar antenna subassembly including an array of RF modules disposed in a reference plane. The planar antenna subassembly also generally includes a planar aperture honeycomb structure. The planar aperture honeycomb structure defines a number of passages in communication with respective RF modules. The phased array antenna of this aspect of the present invention also includes a contoured waveguide subassembly including a contoured aperture honeycomb structure. The contoured aperture honeycomb structure also defines a number of passages extending between the opposed first and second surfaces. The contoured aperture honeycomb structure is disposed with respect to the planar antenna subassembly such that each RF module is in communication with a respective passage of the contoured aperture honeycomb structure. In this regard, the contoured aperture honeycomb structure is generally disposed with respect to the planar aperture honeycomb structure such that respective passages of the contoured and planar aperture honeycomb structures are aligned, thereby placing each RF module in communication with a respective passage of the contoured aperture honeycomb structure.

The contoured aperture honeycomb structure is disposed with respect to the planar antenna subassembly including, for example, the planar aperture honeycomb structure, such that the first surface of the contoured aperture honeycomb structure faces the planar antenna subassembly and the second surface of the contoured aperture honeycomb structure faces away from the planar antenna subassembly. According to the present invention, the second surface of the contoured aperture honeycomb structure is contoured such that at least portions of the second surface are at an oblique angle with respect to the reference plane in which the RF modules are disposed. In other words, at least portions of the second surface are at an oblique angle with respect to a planar surface of the planar aperture honeycomb structure. As such, the second surface of the contoured aperture honeycomb structure may be contoured so as to match or blend into the contour of the surface or skin of the structure to which the phased array antenna is mounted.

The contoured waveguide subassembly may also include a WAIM radome layer. The WAIM radome layer overlies the second surface of the contoured aperture honeycomb structure. In addition, the WAIM radome layer may have the same contoured shape as the second surface of the contoured aperture honeycomb structure, thereby facilitating the conformance of the phased array antenna to the shape of the structure to which the phased array antenna is mounted.

As a result of the contour defined by the second surface of the contoured aperture honeycomb structure, at least some of the passages have different lengths as measured between the opposed first and second surfaces. The contoured waveguide subassembly may also include a number of dielectric inserts disposed within respective passages of the contoured aperture honeycomb structure. Each dielectric insert extends between opposed first and second ends. The dielectric inserts are positioned within the respective passages such that the second ends of the dielectric inserts are proximate the second surface of the contoured aperture honeycomb structure. The second end of at least one dielectric insert is also advantageously contoured to match the contour of that portion of the second surface of the contoured aperture honeycomb structure proximate thereto. As such, the combination of the second surface of the contoured aperture honeycomb structure and the second ends of the dielectric inserts may define a smoothly curved or contoured surface which matches or blends into the contour of the structure to which the phased array antenna is mounted, thereby obviating the need for a fairing, a radome or the like and avoiding the disadvantages associated with the use of a fairing, a radome or the like.

According to another aspect of the present invention, a method of repairing a conformal phased array antenna having a planar antenna subassembly and a contoured waveguide subassembly is provided. According to this method, one of the subassemblies, that is, either the planar antenna subassembly or the contoured waveguide subassembly, is removed while the other subassembly remains installed. For example, the contoured waveguide subassembly may be removed while the planar antenna subassembly remains installed. After removing one of the subassemblies, a subassembly of the same type as the removed subassembly is installed by aligning the subassembly that is being installed with the other subassembly that has remained in place to permit communication therebetween, such as communication between the RF modules of the planar antenna subassembly and the passages defined by the contoured aperture honeycomb structure. The subassembly that is installed may be a repaired version of the same subassembly that was removed or may be a replacement therefor. In either instance, the method of this aspect of the present invention facilitates the efficient repair of the phased array antenna by permitting the phased array antenna to be separated into subassemblies or line replaceable units that may be individually removed and reinstalled without having to similarly remove and reinstall the other subassembly.

BRIEF DESCRIPTION OF THE DRAWINGS

Figure 1:
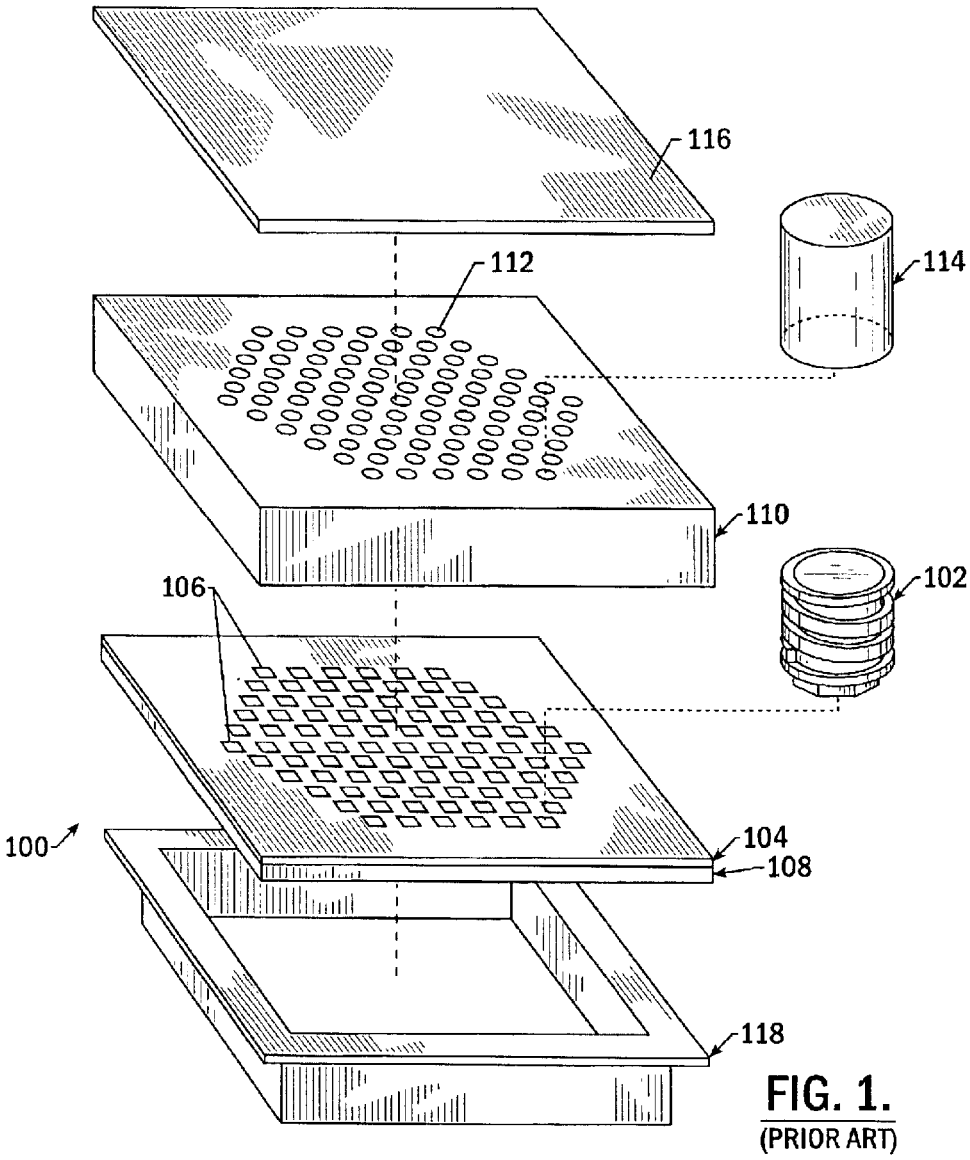
FIG. 1. (PRIOR ART)
Figure 2:
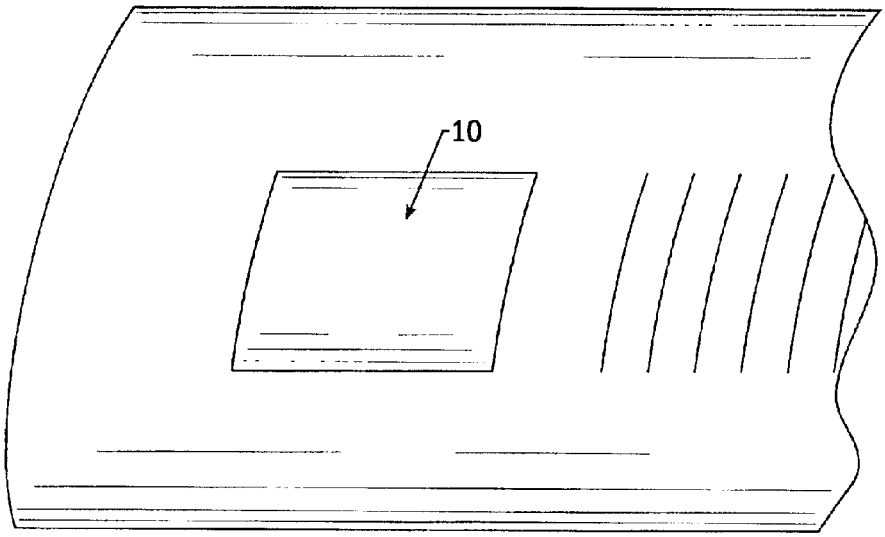
Figure 3:
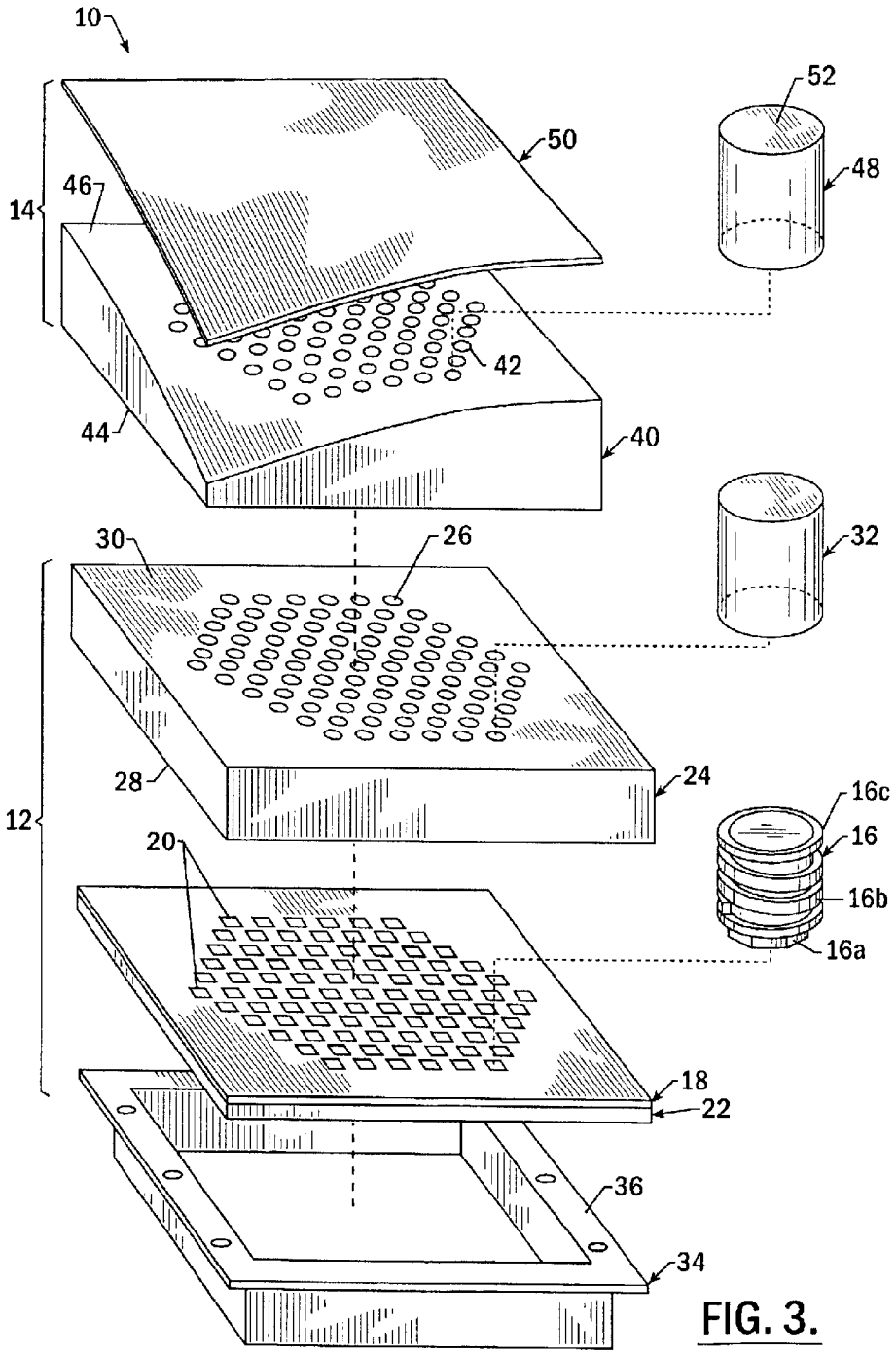
Figure 4:
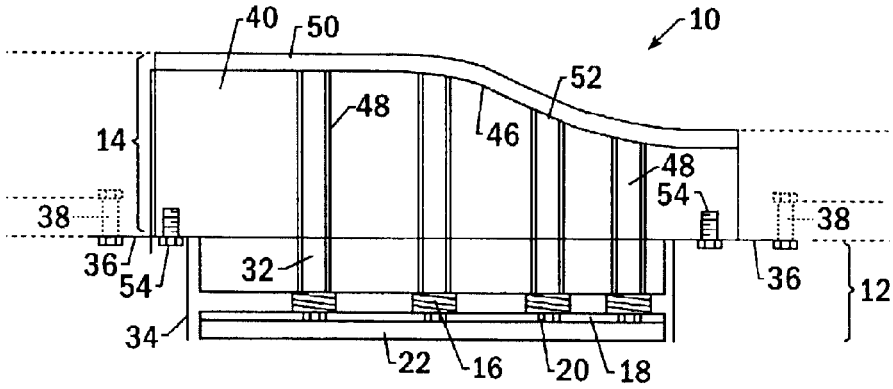

Having thus described the invention in general terms, reference will now be made to the accompanying drawings, which are not necessarily drawn to scale, and wherein:

FIG. 1 is an exploded perspective view of a conventional phased array antenna;

FIG. 2 is a fragmentary perspective view of a portion of complexly shaped structure which includes the phased array antenna of one embodiment of the present invention following mounting of the phased array antenna to the structure and depicting the manner in which the phased array antenna conforms to the shape of the structure;

FIG. 3 is an exploded perspective view of a phased array antenna according to one embodiment to the present invention; and FIG. 4 is an assembled side view of the phased array antenna in FIG. 3.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

A phased array antenna 10 is provided according to the present invention that may conform to the surface of the structure to which the phased array antenna is mounted as shown in FIG. 2. In this regard, the phased array antenna can be mounted to a wide variety of structures including a number of different types of moving structures. In one common application, the phased array antenna is mounted to the surface or skin of an aircraft so as to provide a wide variety of in-flight communications. Even though the surface of the aircraft may have a complex contour, the phased array antenna may have an identical contour as to match and blend into the surface of the aircraft. As a result, the phased array antenna need not be housed within an aerodynamic fairing, a radome or the like and may, instead, be exposed upon the surface of the aircraft. By eliminating the aerodynamic fairing or radome that would otherwise have been required to house the phased array antenna, the aerodynamic performance of the aircraft is improved and the radar cross section of the aircraft is diminished. Moreover, the costs of the antenna structure are reduced by eliminating the cost of the fairing, the radome or other protective enclosure, while potentially improving the RF performance of the antenna.

Although the phased array antenna 10 may be configured in various manners, the phased array antenna of one embodiment of the present invention is depicted in FIGS. 3 and 4. The phased array antenna of this embodiment generally includes a planar antenna subassembly 12 and a contoured waveguide subassembly 14. The planar antenna subassembly includes many of the same components as a conventional phased array antenna such as described above in conjunction with FIG. 1. By utilizing a number of the same components, the cost of the components is generally somewhat reduced relative to the cost of comparable components that would have otherwise been newly designed and unique for the phased array antenna of the present invention.

The planar antenna subassembly 12 includes a plurality of RF modules 16 disposed in a reference plane. The RF modules are of conventional design and include a phase shifter and an amplifier. Further details regarding the RF modules are provided by U.S. Pat. No. 5,276,455 to George W. Fitzsimmons, et al. While the RF modules may be disposed in a reference plane in a variety of manners, the planar antenna subassembly of one embodiment includes a shim element 18 defining a plurality of openings 20 for positioning respective ones of the RF modules. Although the shim element may define the openings in a variety of manners, the shim element of the illustrated embodiment defines the plurality of openings in a predefined array. As shown, the shim element is generally planar and may be formed of various materials including stainless steel. The shim element is also generally quite thin with a thickness typically between about 0.0010" and 0.0050".

The planar antenna subassembly 12 also generally includes a multilayer wiring board 22, also typically planar in construction, upon which the shim element 18 is disposed. As such, the RF modules 16 that are positioned by the respective openings 20 defined by the shim element are also seated upon respective portions of the surface of the multilayer wiring board. Although not shown, the multilayer wiring board includes a number of dielectric layers that carry a plurality of wires, conductive traces and/or other conductive elements. Although not illustrated, the multilayer wiring board is also generally connected to a power supply, such as a +5 VDC and a −5 VDC supply, and to ground. The multilayer wiring board is also generally connected to a system clock and to various data and address lines. Since the RF modules make electrical contact with the multilayer wiring board and, more particularly respective wires, traces or the like carried by the multilayer wiring board, the multilayer wiring board provides power, ground and clock signals to each of the RF modules and permits the transmission of data to and from the respective RF modules as known to those skilled in the art and as described in additional detail by U.S. Pat. No. 5,276,455 to George W. Fitzsimmons, et al.

As mentioned above, the shim element 18 defines a plurality of openings 20 for properly positioning the RF modules 16 relative to the multilayer wiring board 22. The openings are generally precisely photo-etched so as to key the respective RF modules in position. That is, each RF module protrudes through the respective opening and is keyed by the shim element to fit snuggly at an exact depth into the multilayer wiring board, thereby precisely holding each RF module in all dimensions, x, y and depth z. By setting the precise depth of each RF module into the multilayer wiring board, an effective elastomeric connection may be made between each module and the corresponding interface locations on the multilayer wiring board.

It should also be noted that the openings 20 defined by the shim element 18 generally do not completely contain the RF modules 16, but, instead, the RF modules sit somewhat atop the shim element with only a portion, i.e., the multifaceted portion 16*a* depicted in FIG. 3, extending through the openings for contacting the multilayer wiring board 22. As such, the thickness of the shim element is commonly chosen at the time of assembly so as to take up the thickness tolerances inherent in the fabrication of the multilayer wiring board and the RF modules to insure that proper elastomeric connection is established between the RF modules and the multilayer wiring board.

The planar antenna subassembly 12 may also include a planar aperture honeycomb structure 24 defining a number of passages 26 extending between opposed first and second surfaces 28, 30. The passages defined by the planar aperture honeycomb structure are preferably arranged in the same configuration, such as the same predefined array, as the openings 20 defined by the shim element 18. Since the first and second surfaces are generally planar, the planar aperture honeycomb structure may overlie the shim element such that the passages defined by the planar aperture honeycomb structure are aligned with corresponding openings defined by the shim element. As such, the RF modules 16 mounted within respective openings defined by the shim element will be aligned and in communication with respective passages defined by the planar aperture honeycomb structure.

The planar aperture honeycomb structure 24 may be formed of various materials, but is typically formed of a metal, such as aluminum, a conductively coated or conductively plated plastic, a metal matrix composite or a conductively coated composite material. In order to facilitate the transmission of signals to and/or from the RF modules 16 via the respective passages 26, the planar antenna subassembly may also include a plurality of dielectric inserts 32 disposed within respective passages defined by the planar aperture honeycomb structure. The dielectric inserts are generally shaped and sized to fit snugly within the respective passages defined by the planar aperture honeycomb structure.

The dielectric inserts 32 are formed of a dielectric material such as cross-linked polystyrene. As such, the dielectric inserts facilitate the transmission of RF signals to and/or from the RF modules 16 via the respective passages 26. Thus, the phased array antenna 10 may be configured to transmit signals by driving the RF modules to emit signals which then propagate through the dielectric inserts in the respective passages of the planar aperture honeycomb structure. Conversely, the phased array antenna may be configured to receive signals by permitting signals that impinge upon the phased array antenna to propagate through the dielectric inserts in the respective passages of the planar aperture honeycomb structure and be received by the respective RF modules.

Since the RF modules 16 generally sit somewhat atop the shim element 18, each RF module may include a sleeve 16*b* that surrounds the remainder of the RF module and is biased by a spring 16*c* for lengthwise movement toward the planar aperture honeycomb structure 24. See, for example, FIG. 3. Thus, the spring of the RF module of this embodiment urges the sleeve toward and generally into contact with the first surface 28 of the planar aperture honeycomb structure. As a result, the planar aperture honeycomb structure effectively rests upon the spring loaded sleeves of the RF modules. As will be known to those skilled in the art, the sleeves of the RF modules also typically provide a DC ground and a continuous RF path between each RF module and the associated dielectrically loaded passages 26. A gap is also typically formed between the planar aperture honeycomb structure and all portions of the RF modules other than the spring loaded sleeves. While this gap may have various widths, the gap typically has a width of between about 0.0020" and 0.0050". Thus, a coolant, such as air, nitrogen or the like, may be circulated through the gap for cooling purposes and for controlling condensate. While one type of RF module has been described heretofore, it should be apparent to those skilled in the art that other types of RF modules may be utilized without departing from the spirit and scope of the present invention.

The planar antenna subassembly 12 also generally includes an enclosure 34 in which the multilayer wiring board 22, the shim element 18 including the RF modules 16 and the planar aperture honeycomb structure 24 including the dielectric inserts 32 are disposed. Although the enclosure may be formed of various materials such as conductively coated or conductively plated plastics, metal matrix composites or conductively coated composite materials, the enclosure is typically formed of a metal, such as aluminum. In addition, although the enclosure of the illustrated embodiment is shown to be square or rectangular, the enclosure may have any shape that is desired for the particular application. As shown, the enclosure generally has side walls, an open top and an open bottom. The open top permits the transmission and/or reception of signals, while the open bottom permits electrical contact with the multilayer wiring board.

Not only does the enclosure 34 protect the other components of the planar antenna subassembly 12 and maintain these other components in alignment, but the enclosure facilitates the mounting of the planar antenna subassembly to a structure, such as an airframe or the like. For example, the enclosure may define openings through which fasteners extend for engaging the structure to which the planar antenna subassembly is mounted. In this regard, the enclosure may include an outwardly extending flange 36 as shown in FIGS. 3 and 4 which defines a number of openings for receiving fasteners 38 for mounting the planar antenna subassembly to a structure, such as the surface or skin of an aircraft or the like. In this regard, the structure to which the planar antenna subassembly is mounted is shown in dashed lines in FIG. 4. However, this illustration is provided for means of an example and the phased array antenna 10 of the present invention may be mounted in other manners if so desired.

The phased array antenna 10 of the present invention also includes a contoured waveguide subassembly 14. The contoured waveguide subassembly is placed upon and is aligned with the planar antenna subassembly 12 as described below. As such, the contoured waveguide subassembly is generally exterior of the planar antenna subassembly relative to the structure to which the phased array antenna is mounted. As also described below and as shown in FIG. 2, the contoured waveguide subassembly is generally proximate the surface or skin of the structure to which the phased array antenna is mounted and generally has an exterior shape or contour that matches or blends into the shape or contour of surrounding portions of the surface or skin of the structure to which the phased array antenna is mounted. As such, the phased array antenna advantageously need not be housed within a fairing, a radome or the like.

The contoured waveguide subassembly 14 includes a contoured aperture honeycomb structure 40. Like the planar aperture honeycomb structure 24, the contoured aperture honeycomb structure defines a number of passages 42 extending between opposed first and second surfaces 44, 46. Typically, the contoured aperture honeycomb structure defines the same number and the same arrangement of passages as does the planar aperture honeycomb structure and, in turn, the shim element 18. As such, the contoured waveguide subassembly may be mounted upon the planar antenna subassembly such that passages defined by the contoured aperture honeycomb structure are aligned and in communication with respective passages 26 defined by the planar aperture honeycomb structure.

The contoured aperture honeycomb structure 40 is typically formed of aluminum or another metal, but may be formed of other materials, such as a conductively coated or conductively plated plastic, a metal matrix composite or a conductively coated composite material, if so desired. To facilitate the propagation of signal through the passages 42, the contoured waveguide subassembly 14 may include a plurality of dielectric inserts 48. The dielectric inserts are disposed within respective passages of the contoured aperture honeycomb structure. While the dielectric inserts may be formed of various dielectric materials, the dielectric inserts are formed of cross-linked polystyrene in one embodiment. The dielectric inserts are generally shaped and sized in such a manner as to be snuggly received within the respective passages defined by the contoured aperture honeycomb structure. As such, in instances in which the phased array antenna 10 is configured to transmit signals, the RF modules 16 will transmit signals which propagate through the dielectric inserts 32 disposed within the respective passages 26 defined by the planar aperture honeycomb structure 24 and, in turn, through the dielectric inserts in the respective passages defined by the contoured aperture honeycomb structure. Conversely, in instances in which the phased array antenna is configured to receive signals, signals incident upon the phased array antenna will propagate through the dielectric inserts disposed within the respective passages defined by the contoured aperture honeycomb structure and, in turn, through the dielectric inserts disposed within the respective passages defined by the planar aperture honeycomb structure prior to being received by the RF modules.

The contoured waveguide subassembly 14 also generally includes a WAIM radome layer 50. The WAIM radome layer is disposed upon the second surface 46 of the contoured aperture honeycomb structure 40 that faces away from the planar antenna subassembly 12. The WAIM radome layer is of a generally conventional construction designed to mitigate the impact of mutual coupling effects on the aperture performance at relatively high scan angles. In this regard, the WAIM radome layer generally includes one or more foam layers and one or more layers of resin impregnated fabrics. As described in more detail below, for example, the WAIM radome layer may include a foam layer disposed upon the second surface of the contoured aperture honeycomb structure that is, in turn, covered with a facesheet formed of a resin impregnated fabric.

While the first surface 44 of the contoured aperture honeycomb structure 40 that faces the planar antenna subassembly 12 may be planar, the second surface 46 of the contoured aperture honeycomb structure is generally curved or otherwise contoured so as to match or blend into the shape or contour of the surface or skin of the structure to which the phased array antenna 10 is mounted. As a result, at least portions of the second surface are at an oblique angle with respect to the reference plane in which the RF modules 16 are disposed. Similarly, at least portions of the second surface of the contoured aperture honeycomb structure are at an oblique angle with respect to a surface, such as the first and/or second surface 28, 30, of the planar aperture honeycomb structure 24. The particular shape or contour of the second surface of the contoured aperture honeycomb structure is governed by the shape or contour of that portion of the surface or skin of the structure to which the phased array antenna is mounted such that the phased array antenna conforms to the structure as shown in FIG. 4 in which the surrounding structure is shown in dashed lines. For example, the phased array antenna may be mounted to the surface or skin or an aircraft having a complexly curved shape as shown in FIG. 2. As such, the second surface of the contoured aperture honeycomb structure will have the same complexly curved shape so as to match or blend into the surface or skin of the aircraft.

In order to have a relatively continuous surface, the portions of dielectric inserts 48 that are exposed via the passages 42 defined by the contoured aperture honeycomb structure 40 may also be contoured. In this regard, the dielectric inserts may extend between opposed first and second ends and may be positioned within respective passages such that the second ends 52 of the dielectric inserts are proximate the second surface 46 of the contoured aperture honeycomb structure. As such, the second ends of the dielectric inserts may have a contour that matches the contour of that portion of the second surface of the contoured aperture honeycomb structure proximate the respective dielectric inserts. Thus, the resulting surface consisting of the second surface of the contoured aperture honeycomb structure and the second ends of the dielectric inserts will have a relatively continuous, contoured shape.

Although the dielectric inserts 48 can be formed and installed in various manners, the contoured aperture honeycomb structure 40 of one embodiment defines passages 42 which have a shoulder proximate one end of each passage, i.e., the end of the passage proximate the first surface 44 of the contoured aperture honeycomb structure. In this regard, the passages may be formed by initially punching or drilling holes having a first diameter completely through the planar aperture honeycomb structure. The majority of each hole is then drilled and reamed to a second, larger diameter. In particular, each hole is formed to have the second, larger diameter from the end of the passage proximate the second surface 46 of the contoured aperture honeycomb structure to a location near the other end proximate the first surface. However, an annular shoulder which defines an opening having the first, smaller opening remains proximate the other end proximate the first surface. The dielectric inserts are then inserted into the passages such that the first end of each dielectric insert contacts and is supported by the annular shoulder. While the dielectric inserts could initially be sized to the desired length, the dielectric inserts commonly have a greater length than that of the passages such that the second end of the dielectric inserts extends beyond the second surface of the contoured aperture honeycomb structure. Adhesive is then injected into the passages around the dielectric inserts, a vacuum is pulled to securely seat the dielectric inserts and the assembly is cured, typically in an autoclave. Once cured, the second surface of the contoured aperture honeycomb structure beyond which the second ends of the dielectric inserts extend is machined or cut to the proper dimensions, such as by a CNC machine, thereby also removing those portions of the dielectric inserts that protruded beyond the second surface of the contoured aperture honeycomb structure and leaving the second ends of the dielectric inserts flush with the second surface and having the same contour as those portions of the second surface proximate thereto. The opposed first surface of the contoured aperture honeycomb structure is then similarly machined or cut to the proper dimensions so as to remove the annular shoulder proximate the end of each passage.

As a result of the contoured shape of the second surface 46 of the contoured aperture honeycomb structure 40, the WAIM radome layer 50 also generally has the same contoured shape since the WAIM radome layer is generally mounted upon the second surface of the contoured aperture honeycomb structure. The WAIM radome layer may be formed into the contoured shape in several manners. In the embodiment in which the WAIM radome layer is formed of one or more layers of foam and one or more layers of resin impregnated fabric, the foam layer(s) and the layer(s) of resin impregnated fabric may be formed flat and then bonded to the contoured second surface of the contoured aperture honeycomb structure so as to take on the same contoured shape. Alternatively, the foam layer(s) and/or the layer(s) of resin impregnated fabric may be formed to have the same contoured shape as the second surface of the contoured aperture honeycomb structure. For example, a mold having the same contoured shape as the second surface of the contoured aperture honeycomb structure may be utilized to preform the foam layer(s) and/or the layer(s) of resin impregnated fabric to the desired shape. As another example, the layer(s) of resin impregnated fabric may be co-cured with the foam layer(s) upon the second surface of the contoured aperture honeycomb structure so as to have the desired shape. Typically, the foam(s) and the layer(s) of resin impregnated fabric may be formed flat and then bonded to the contoured second surface of the contoured aperture honeycomb structure in instances in which the second surface has a relatively small degree of curvature, while the foam layer(s) and/or the layer(s) of resin impregnated fabric may be formed to have the same contoured shape as the second surface of the contoured aperture honeycomb structure in instances in which the second surface has a larger degree of curvature.

As a result of the contoured shape of the second surface of the contoured aperture honeycomb structure, the passages 42 defined by the contoured aperture honeycomb structure may have different lengths as measured between the opposed first and second surfaces 44, 46. In order to compensate for the time differences required for propagation of the signals through passages having different lengths, a respective phase compensation value is associated with each RF module 16. These phase compensation values are typically stored in memory and utilized during signal transmission and reception to account for the phase differences incurred as a result of the different lengths of the passages. In addition to or instead of a phase compensation value, a time delay compensation value may be associated with each RF module and utilized during signal transmission and reception to account for the phase differences incurred as a result of the different lengths of the passages, if the RF modules have time delay circuitry.

The contoured aperture honeycomb structure 40 may be fabricated in various manners in order to have the desired contoured shape. For those embodiments in which the contoured aperture honeycomb structure is formed of a metal, such as aluminum, a metal matrix composite or other composite materials, the second surface 46 of the contoured aperture honeycomb structure may be machined or cut to have the desired contour as described above. Alternatively, in those embodiments in which the contoured aperture honeycomb structure is formed of a plastic, the contoured aperture honeycomb structure may be injection molded within a mold that forms the desired contour across the second surface. In any event, the contoured waveguide subassembly permits the phased array antenna 10 to be mounted proximate the surface or skin of a structure in a manner that conforms to the shape or contour of the surface or skin of the structure, thereby permitting the phased array antenna to be mounted independent of a fairing, radome or other protective enclosure.

The contoured waveguide subassembly 14 is generally mounted to the planar antenna subassembly 12 to form an integral phased array antenna 10. Once the contoured waveguide subassembly has been aligned with the planar antenna subassembly as described above such that the respective passages are aligned, the contoured waveguide subassembly may be secured to the planar antenna subassembly in various manners. For example, the contoured waveguide subassembly and, in particular, the contoured aperture honeycomb structure 40 may define openings proximate the periphery thereof through which connectors or other fasteners 54 may extend for engaging the planar antenna subassembly, such as the outwardly extending flange 36 of the enclosure 34. However, the contoured waveguide subassembly may be secured to the planar antenna subassembly in other manners, if so desired.

Since the phased array antenna 10 of the present invention is generally comprised of a pair of subassemblies or line replaceable units, the phased array antenna of the present invention may be repaired in a relatively efficient manner if either subassembly should begin to function improperly. In this regard, the subassembly which has begun to function improperly may be removed while the other subassembly remains installed. For example, in instances in which the contoured waveguide subassembly 14 begins to function improperly, the contoured waveguide subassembly may be disconnected from the planar antenna subassembly 12 and removed, while the planar antenna subassembly remains mounted to the structure. Since the planar antenna subassembly defines the electrical performance of the antenna, the repair method of this aspect of the present invention avoids having to perform extensive RF testing and calibration upon the phased array antenna after the repair by permitting the planar antenna subassembly to remain installed during the repair process. Alternatively, in instances in which the planar antenna subassembly begins to function improperly, the planar antenna subassembly may be disconnected from the contoured waveguide subassembly and removed, while the contoured waveguide subassembly remains mounted to the structure, thereby avoiding any disruption of the edge treatment that bridges from the phased array antenna to the surrounding surface or skin of the structure to which the phase array antenna is mounted. The subassembly that has been removed may then be repaired or replaced and is then reinstalled, such as by being aligned with and reconnected to the other subassembly that has remained mounted to the structure such that the phased array antenna is again capable of functioning properly. By forming the phased array antenna of two distinct line replaceable units or subassemblies, however, the phased array antenna may be rapidly repaired with a minimum of down time.

The contoured waveguide subassembly 14 has been primarly described as a removable subassembly. However, the contoured waveguide subassembly may be permanently mounted to the platform to meet the structural requirements of some applications.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A phased array antenna comprising:

a planar antenna subassembly comprising an array of radio frequency (RF) modules disposed in a reference plane; and a contoured waveguide subassembly comprising a contoured aperture honeycomb structure defining a plurality of passages extending between opposed first and second surfaces, said contoured aperture honeycomb structure disposed with respect to said planar antenna subassembly such that each RF module is in communication with a respective passage of said contoured aperture honeycomb structure, said contoured aperture honeycomb structure also disposed with respect to said planar antenna subassembly such that the second surface of said contoured aperture honeycomb structure faces away from said planar antenna subassembly and is contoured such that at least portions of the second surface are at an oblique angle with respect to the reference plane.

2. A phased array antenna according to claim 1 wherein said contoured waveguide subassembly further comprises a wide angle impedance match (WAIM) radome layer overlying the second surface of said contoured aperture honeycomb structure.

3. A phased array antenna according to claim 2 wherein said WAIM radome layer has the same contoured shape as the second surface of said contoured aperture honeycomb structure.

4. A phased array antenna according to claim 1 wherein said contoured waveguide subassembly further comprises a plurality of dielectric inserts disposed within respective passages of said contoured aperture honeycomb structure.

5. A phased array antenna according to claim 4 wherein each dielectric insert extends between opposed first and second ends with the second ends of said dielectric inserts disposed proximate the second surface of said contoured aperture honeycomb structure, and wherein the second end of at least one dielectric insert is contoured to match the contour of that portion of the second surface of the said contoured aperture honeycomb structure proximate the second end of the respective dielectric insert.

6. A phased array antenna according to claim 1 wherein the first surface of said contoured aperture honeycomb structure is planar and at least a portion of the second surface of said contoured aperture honeycomb structure is at an oblique angle relative to the planar first surface.

7. A phased array antenna according to claim 1 wherein at least some of the passages defined by said contoured aperture honeycomb structure have different lengths as measured between the opposed first and second surfaces.

8. A phased array antenna according to claim 1 wherein said planar antenna subassembly further comprises a planar aperture honeycomb structure defining a plurality of passages in communication with respective RF modules and with respective passages defined by said contoured aperture honeycomb structure.

9. A phased array antenna comprising:

an array of radio frequency (RF) modules;

a planar aperture honeycomb structure defining a plurality of passages in communication with respective RF modules; and a contoured aperture honeycomb structure defining a plurality of passages extending between opposed first and second surfaces, said contoured aperture honeycomb structure disposed with respect to said planar aperture honeycomb structure such that respective passages of said contoured and planar aperture honeycomb structures are aligned, said contoured aperture honeycomb structure also disposed with respect to said planar aperture honeycomb structure such that the first surface of said contoured aperture honeycomb structure faces said planar aperture honeycomb structure and the second surface faces away from said planar aperture honeycomb structure, wherein the second surface of said contoured aperture honeycomb structure is contoured such that at least portions of the second surface are at an oblique angle with respect to a surface of said planar aperture honeycomb structure.

10. A phased array antenna according to claim 9 further comprising a wide angle impedance match (WAIM) radome layer overlying the second surface of said contoured aperture honeycomb structure.

11. A phased array antenna according to claim 10 wherein said WAIM radome layer has the same contoured shape as the second surface of said contoured aperture honeycomb structure.

12. A phased array antenna according to claim 9 further comprising a plurality of dielectric inserts disposed within respective passages of said contoured aperture honeycomb structure.

13. A phased array antenna according to claim 12 wherein each dielectric insert extends between opposed first and second ends with the second ends of said dielectric inserts disposed proximate the second surface of said contoured aperture honeycomb structure, and wherein the second end of at least one dielectric insert is contoured to match the contour of that portion of the second surface of the said contoured aperture honeycomb structure proximate the second end of the respective dielectric insert.

14. A phased array antenna according to claim 9 wherein the first surface of said aperture honeycomb structure is planar.

15. A phased array antenna according to claim 9 wherein at least some of the passages defined by said contoured aperture honeycomb structure have different lengths as measured between the opposed first and second surfaces.

16. A method of repairing a conformal phased array antenna comprised of a planar antenna subassembly including an array of radio frequency (RF) modules disposed in a reference plane and a contoured waveguide subassembly including an aperture honeycomb structure having a surface that faces away from the planar antenna subassembly that is contoured such that at least portions of the second surface are at an oblique angle with respect to the reference plane, and wherein the method comprises:

removing one of the subassemblies selected from the group consisting of the planar antenna subassembly and the contoured waveguide subassembly while the other subassembly remains installed; and thereafter installing a subassembly of the same type as the removed subassembly, wherein installing the subassembly comprises aligning the subassembly being installed with the other subassembly that has remained installed to permit communication therebetween.

17. A method according to claim 16 wherein removing one of the subassemblies comprises removing the contoured waveguide subassembly while the planar antenna subassembly remains installed.

18. A method according to claim 16 further comprising repairing the removed subassembly prior to installing the repaired subassembly.

19. A method according to claim 16 further comprising obtaining a replacement for the removed subassembly prior to installing the replacement subassembly.

20. An assembly comprising:

a structure having a contoured surface; and a conformal phased array antenna comprising:

a planar antenna subassembly comprising an array of radio frequency (RF) modules disposed in a reference plane; and a contoured waveguide subassembly comprising a contoured aperture honeycomb structure defining a plurality of passages extending between opposed first and second surfaces, said contoured aperture honeycomb structure disposed with respect to said planar antenna subassembly such that each RF module is in communication with a respective passage of said contoured aperture honeycomb structure, said contoured aperture honeycomb structure also disposed with respect to said planar antenna subassembly such that the second surface of said contoured aperture honeycomb structure faces away from said planar antenna subassembly and is contoured such that at least portions of the second surface are at an oblique angle with respect to the reference plane and further such that the contoured second surface conforms with at least portions of the contoured surface of said structure proximate said conformal phased array antenna.

21. An assembly according to claim 20 wherein said contoured waveguide subassembly of said conformal phased array antenna further comprises a wide angle impedance match (WAIM) radome layer overlying the second surface of said contoured aperture honeycomb structure.

22. An assembly according to claim 21 wherein said WAIM radome layer has the same contoured shape as the second surface of said contoured aperture honeycomb structure.

23. An assembly according to claim 20 wherein said contoured waveguide subassembly of said conformal phased array antenna further comprises a plurality of dielectric inserts disposed within respective passages of said contoured aperture honeycomb structure.

24. An assembly according to claim 23 wherein each dielectric insert extends between opposed first and second ends with the second ends of said dielectric inserts disposed proximate the second surface of said contoured aperture honeycomb structure, and wherein the second end of at least one dielectric insert is contoured to match the contour of that portion of the second surface of the said contoured aperture honeycomb structure proximate the second end of the respective dielectric insert.

* * * * *